US006443038B2

(12) United States Patent
Hsieh

(10) Patent No.: US 6,443,038 B2
(45) Date of Patent: Sep. 3, 2002

(54) OPEN-END WRENCH FOR TURNING NORMAL AND WORN-OUT BOLTS AND NUTS OF DIFFERENT SPECIFICATIONS

(76) Inventor: Chin-Ching Hsieh, No. 64, Lane 107, Liang Tsun Rd., Fong Yuan City, Taichung Hsien (TW)

( * ) Notice: Subject to any disclaimer, the term of this patent is extended or adjusted under 35 U.S.C. 154(b) by 0 days.

(21) Appl. No.: 09/880,025

(22) Filed: Jun. 14, 2001

Related U.S. Application Data

(63) Continuation-in-part of application No. 09/283,985, filed on Apr. 2, 1999, now abandoned, which is a continuation-in-part of application No. 09/021,815, filed on Feb. 11, 1998, now abandoned.

(51) Int. Cl.[7] ..... B25B 13/02
(52) U.S. Cl. ..... 81/119; 81/186
(58) Field of Search ..... 81/119, 186

(56) References Cited

U.S. PATENT DOCUMENTS 3,921,475 A 11/1975 Evans
3,921,476 A 11/1975 Evans
5,551,322 A 9/1996 Mikic et al.
5,878,636 A * 3/1999 Baker ..... 81/119
6,269,715 B1 * 8/2001 Cagny ..... 81/119

* cited by examiner

*Primary Examiner*—James G. Smith
(74) *Attorney, Agent, or Firm*—Rosenberg, Klein & Lee

(57) ABSTRACT

An open-end wrench is provided with a mouth between two jaws and a nest interconnecting the two jaws, a first convex surface portion is provided on the first jaw driving surface; and a first transverse tooth, a second transverse tooth and a second convex surface portion is provided on the second jaw driving surface. The first transverse tooth, the second transverse tooth and the second convex surface portion of the second jaw are respectively arranged at predetermined distances from the first convex surface portion of the first jaw driving surface. Further, the distance between the first transverse tooth and the second transverse tooth is 3/25 of the distance between the first convex surface portion of the first jaw driving surface and the first transverse tooth. This structural shaped and dimensional open-end wrench structural arrangement represents an improvement in grasping and turning new-type bolts and nuts as well as worn-out bolts and nuts.

3 Claims, 14 Drawing Sheets

OPEN-END WRENCH FOR TURNING NORMAL AND WORN-OUT BOLTS AND NUTS OF DIFFERENT SPECIFICATIONS

CROSS REFERENCE TO RELATED APPLICATION

This application is a continuation-in-part application of U.S. Ser. No. 09/283,985, filed Apr. 2, 1999, now abandoned, which is a continuation-inpart application of U.S. Ser. No. 09/021,815, filed Feb. 11, 1998, now abandoned.

BACKGROUND AND SUMMARY OF THE INVENTION

The present invention relates to an open-end wrench, and more particularly to an open-end wrench structural arrangement which represents an improvement in grasping and turning normal or newly-made bolts and nuts of different sizes and/or specifications as well as worn-out bolts and nuts of different sizes and/or specifications.

An open-end wrench is a handy tool that is intensively used for grasping and turning such fasteners as bolts and nuts. Open-end wrenches of the prior art disclose various structural arrangements that include teeth, raised portions and/or rough grasping faces on the jaws that are used for the desired functions of grasping and turning normal bolts and nuts as well as worn-out bolts and nuts. Examples of prior art open-end wrenches of different structural arrangements are shown in FIGS. 1 to 14. The open-end wrenches shown in FIGS. 1 and 2 are especially designed for grasping and turning hexagon head bolts and nuts of different sizes. Further, the open-end wrenches shown in FIGS. 1 to 4 are especially designed for turning worn-out hexagon head bolts and nuts. These prior art wrench designs are operative for turning head bolts that start to wear slightly, however such open-end wrenches do not positively grasp and turn excessively worn-out bolts and nuts in an acceptable and efficient manner.

It is a general object of the present invention to provide an improved structural arrangement for an open-end wrench which avoids the disadvantages of the prior art wrenches illustrated herein while providing additional structural and operating advantages.

It is another object of the present invention to provide an open-end wrench which represents an improved structural arrangement for grasping and turning such fasteners as hexagon head bolts and hexagon nuts as well as square head bolts and square nuts.

It is another object of the present invention to provide an open-end wrench which represents an improved structural arrangement for grasping and turning normal bolts and nuts of different specifications as well as worn-out bolts and nuts of different specifications. According to the present invention, the open-end wrench comprises a mouth defined between two jaws and a nest portion interconnecting the two jaws, a first convex surface portion being provided on the first jaw driving surface; a first transverse tooth, a second transverse tooth and a second convex surface portion being provided on the second jaw driving surface; wherein the first transverse tooth, the second transverse tooth and the second convex surface portion of the second jaw being arranged at predetermined distances from the first convex surface portion of the first jaw driving surface. Further, the distance between the first transverse tooth and the second transverse tooth is arranged to be 3/25 of the distance between the first convex surface portion of the first jaw driving surface and the first transverse tooth. By means of the aforesaid structural shapes and critical dimensions, the open-end wrench of the present invention has improvements in grasping and turning normal bolts and nuts as well as worn-out bolts and nuts.

DETAILED DESCRIPTION OF THE PREFERRED EMBODIMENTS

Figure 2:
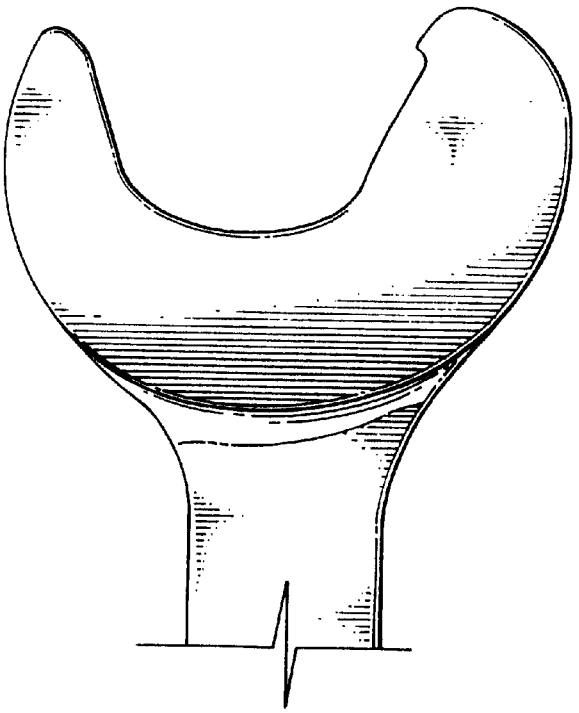
Fig. 2 PRIOR ART
FIG. 2 is a front view of another open-end wrench structural arrangement according to the prior art.
Figure 1:
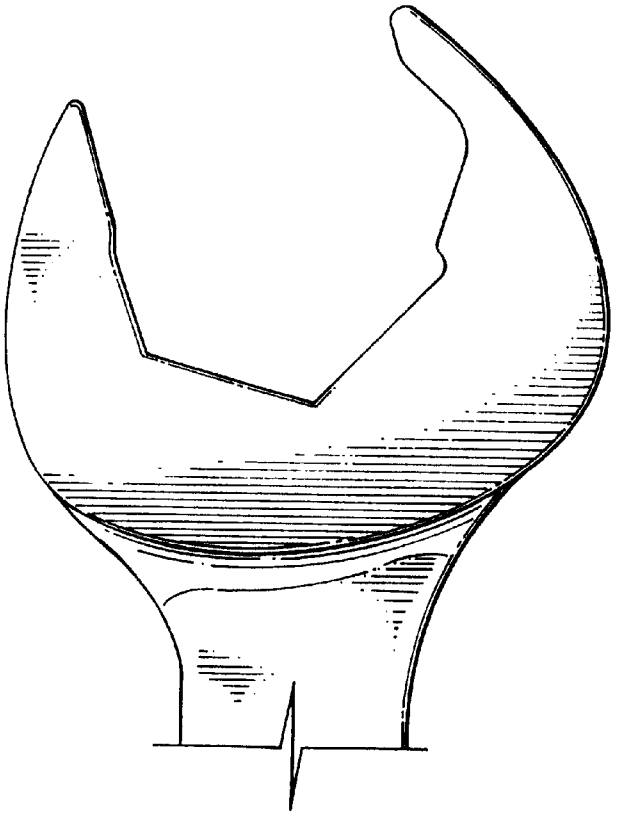
Fig. 1 PRIOR ART
FIG. 1 is a front view of an open-end wrench structural arrangement according to the prior art.
Figure 4:
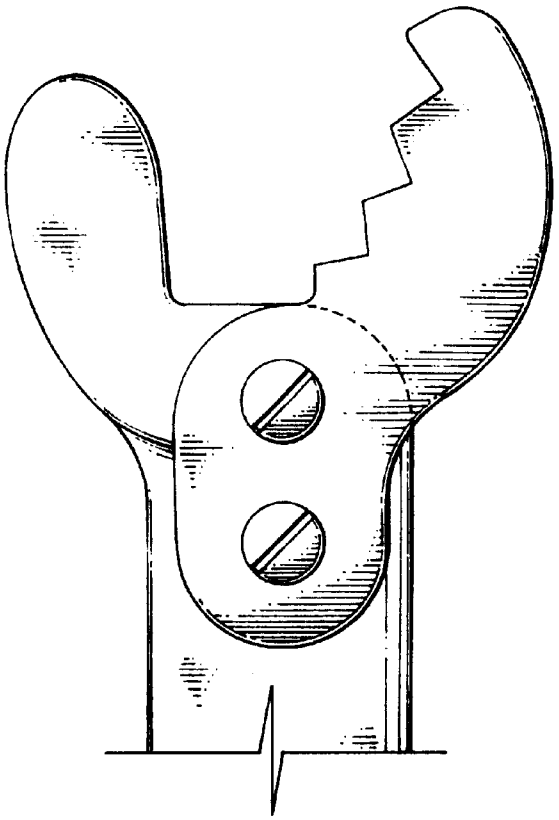
Fig. 4 PRIOR ART
FIG. 4 is a front view of still another open-end wrench structural arrangement according to the prior art.
Figure 3:
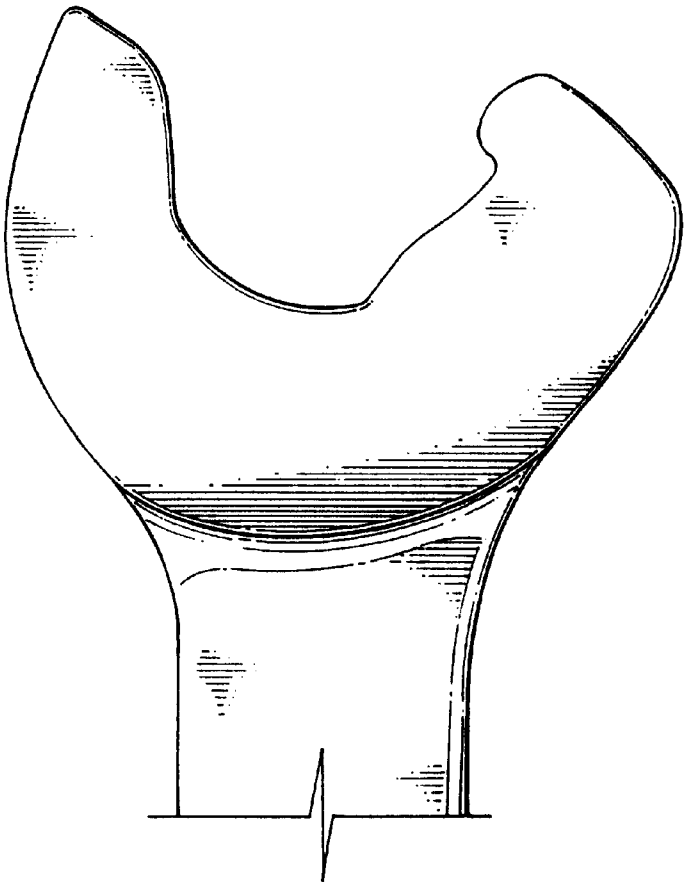
Fig. 3 PRIOR ART
FIG. 3 is a front view of still another open-end wrench structural according to the prior art.
Figure 6:
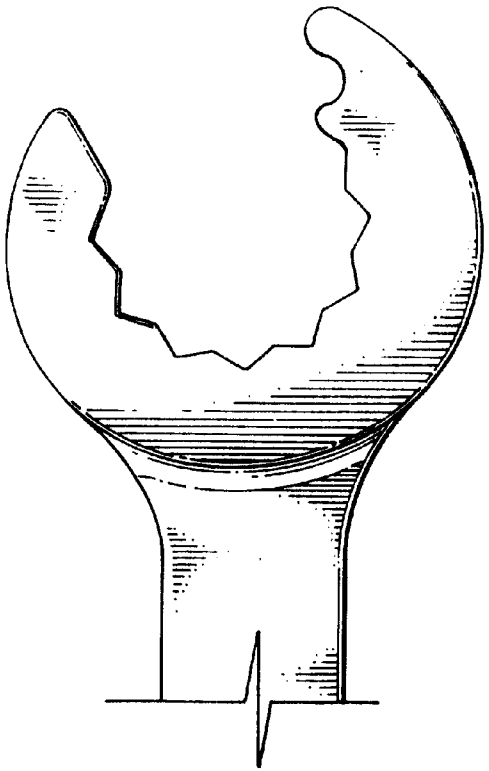
Fig. 6 PRIOR ART
FIG. 6 is a front view of still another open-end wrench structural arrangement according to the prior art.
Figure 5:
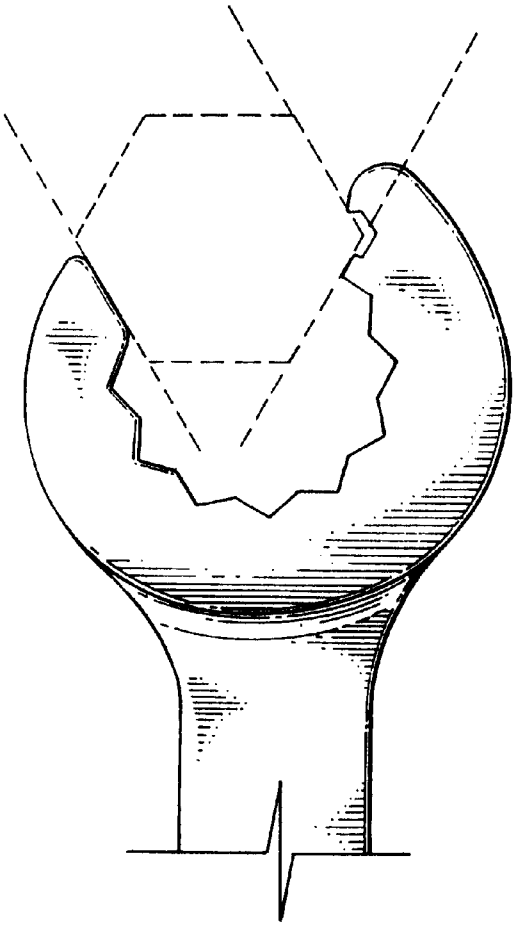
Fig. 5 PRIOR ART
FIG. 5 is a front view of still another prior art open-end wrench structural arrangement, showing a hexagon fastener in dotted lines operatively inserted therein.
Figure 8:
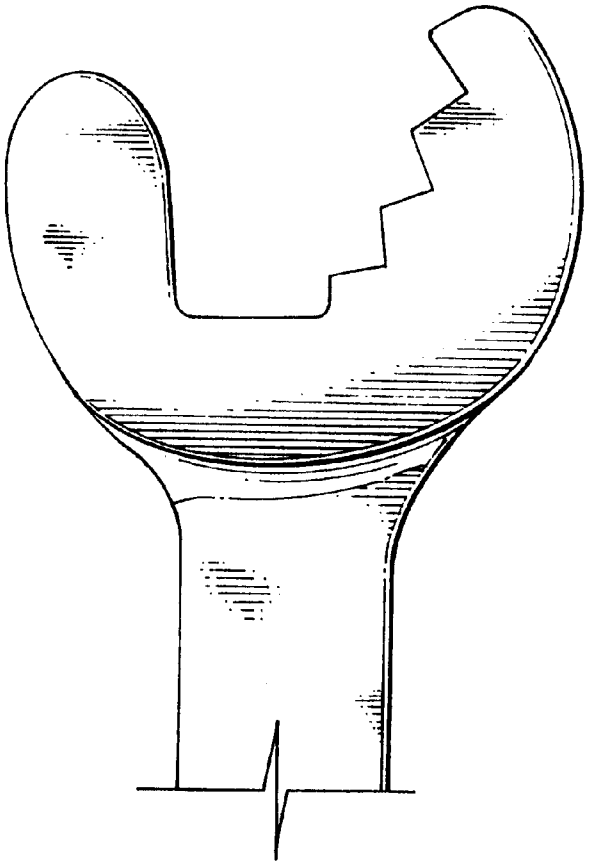
Fig. 8 PRIOR ART
FIG. 8 is a front view of still another open-end wrench structural arrangement according to the prior art.
Figure 7:
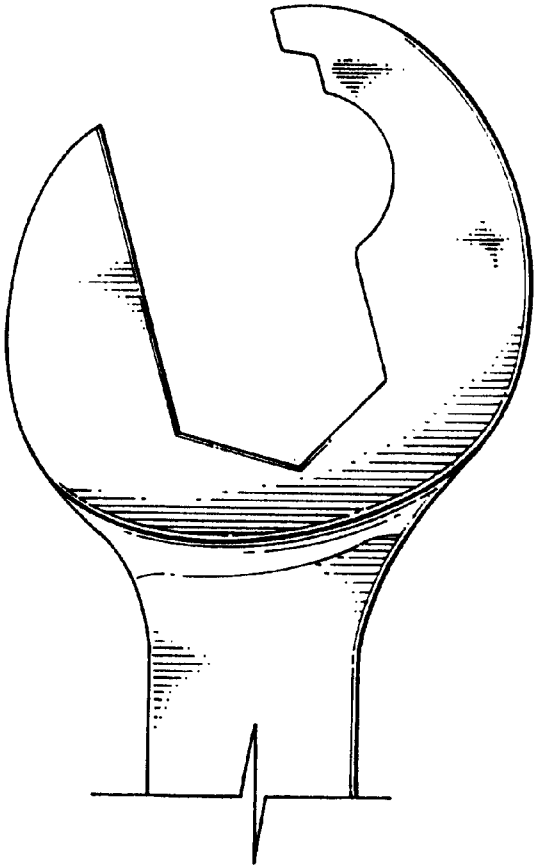
Fig. 7 PRIOR ART
FIG. 7 is a front view of still another open-end wrench structural arrangement according to the prior art.
Figure 10:
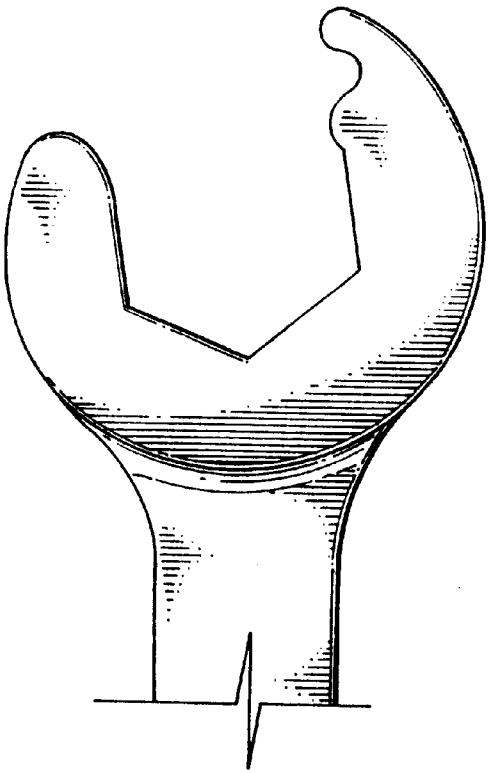
Fig. 10 PRIOR ART
FIG. 10 is a front view of still another open-end wrench structural arrangement according to the prior art.
Figure 9:
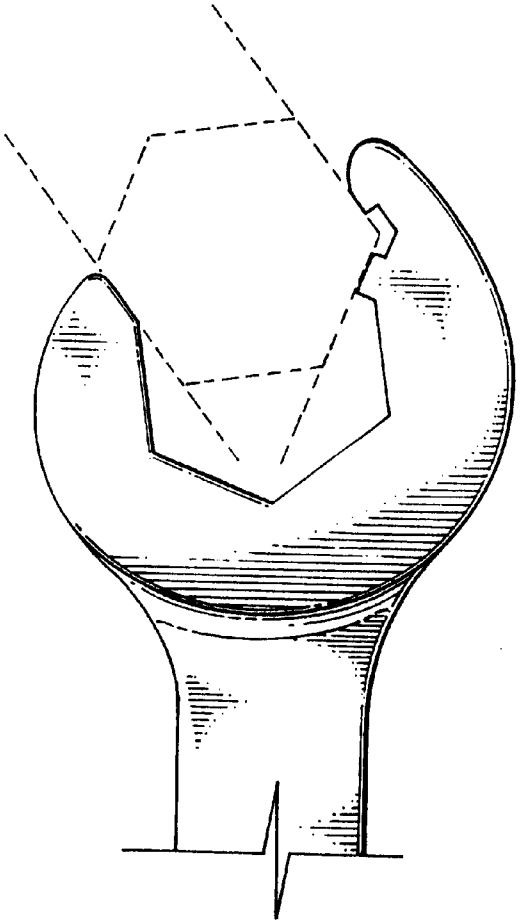
Fig. 9 PRIOR ART
FIG. 9 is a front view of still another prior art open-end wrench structural arrangement, showing a hexagon fastener in dotted lines operatively inserted therein.
Figure 11:
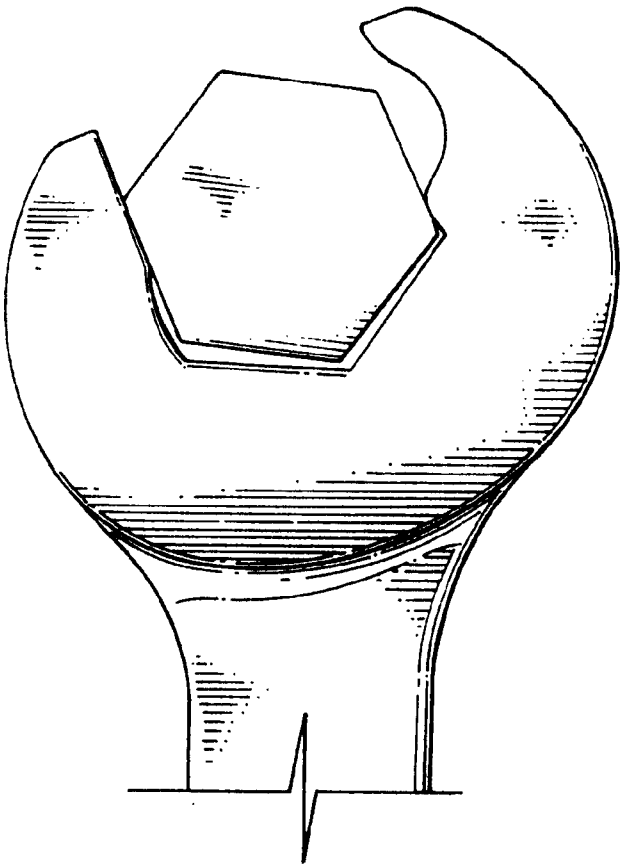
Fig. 11 PRIOR ART
FIG. 11 is a front view of still another prior art open-end wrench structural arrangement, showing a hexagon fastener operatively inserted therein.
Figure 14:
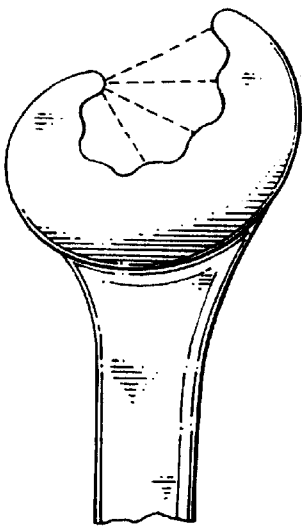
Fig. 14 PRIOR ART
FIG. 14 is a front view of still another prior art open-end wrench structural arrangement, showing various radii distances within the mouth.
Figure 13:
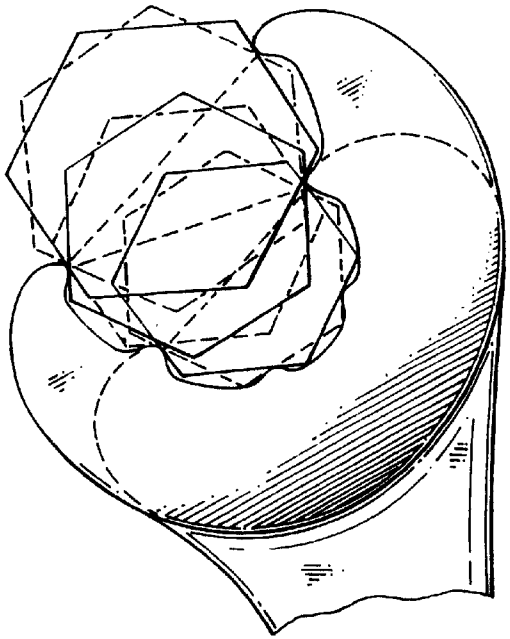
Fig. 13 PRIOR ART
FIG. 13 is a front view of still another prior art open-end wrench structural arrangement with a hexagon fastener inserted therein, showing the bolt in various positions within the mouth.
Figure 12:
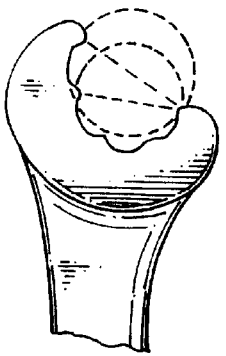
Fig. 12 PRIOR ART
FIG. 12 is a front view of still another structure of a prior art open-end wrench structural arrangement, showing various radii distances within the mouth.
Figure 15:
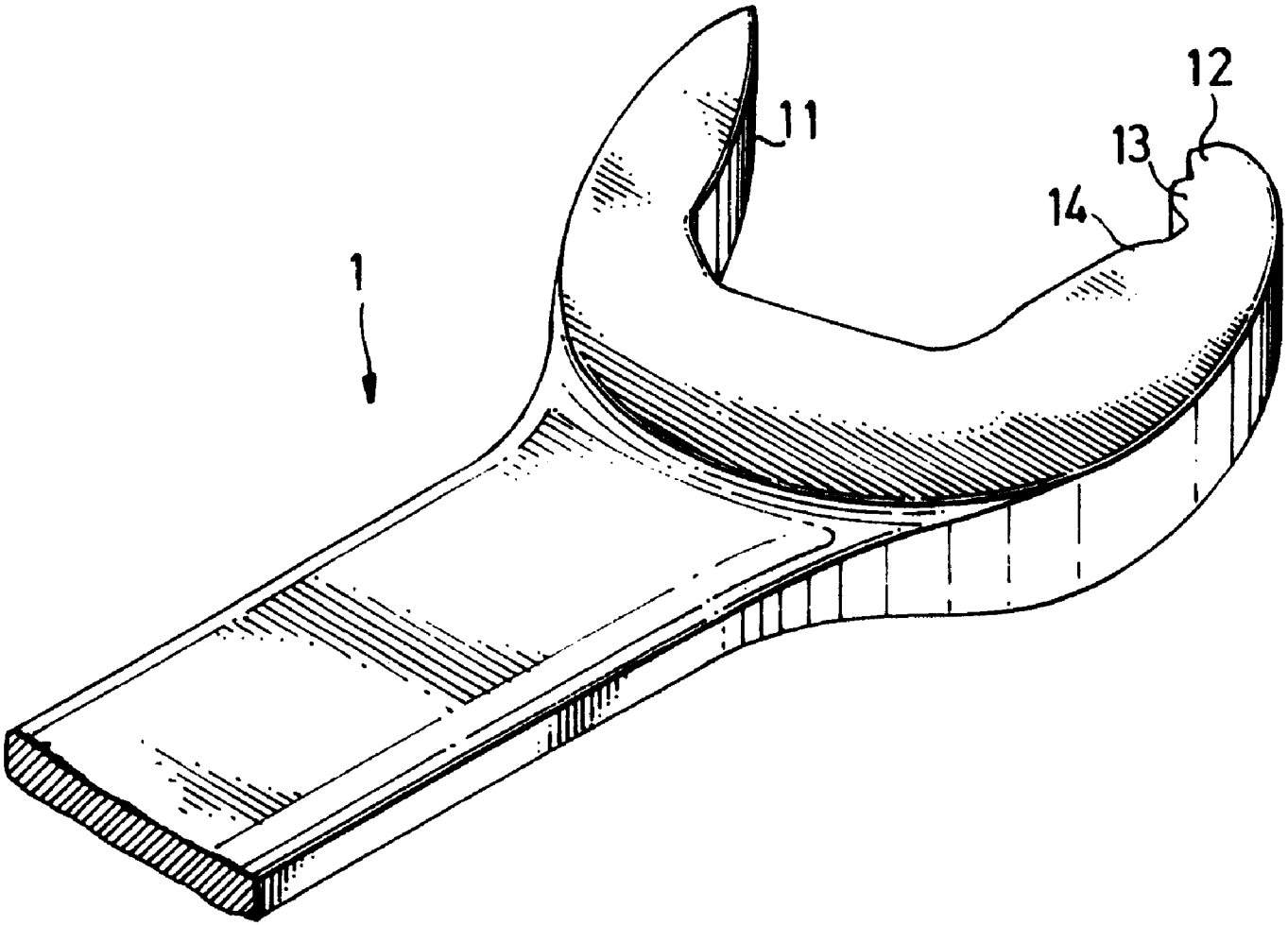
FIG. 15 is a perspective view of an open-end wrench structural arrangement according to the first embodiment of the present invention.
Figure 16:
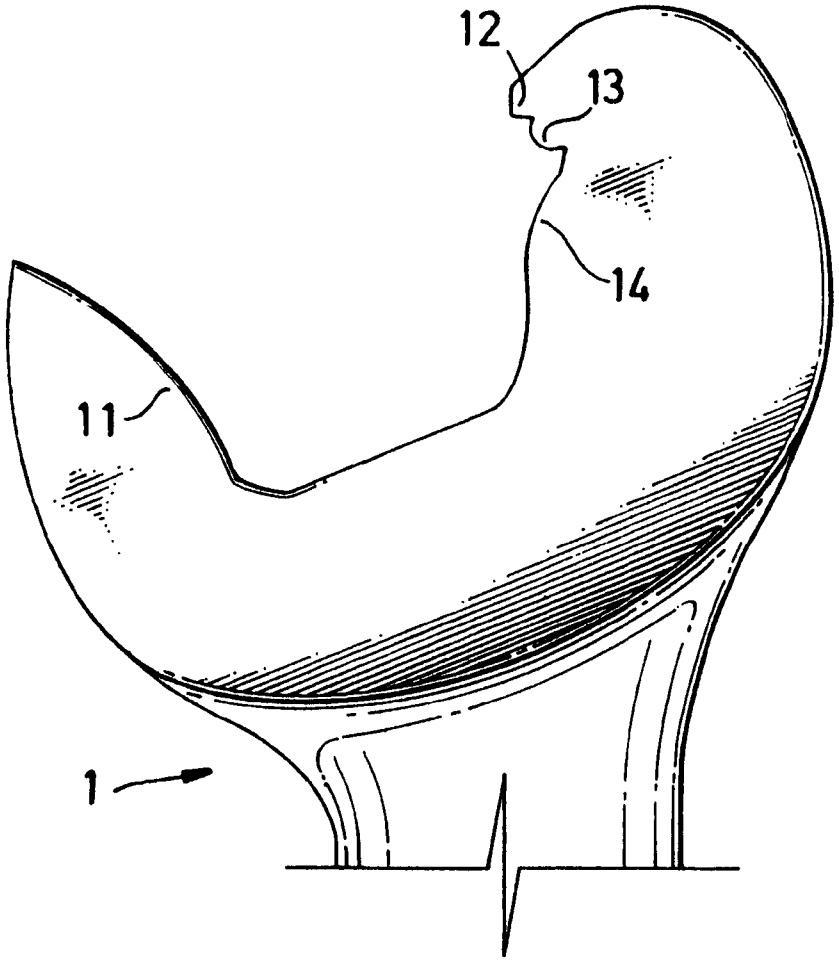
FIG. 16 is a front view of the first embodiment.

Referring to FIGS. 15 to 19, there is illustrated an open-end wrench, defined by the numeral 1, according to the first embodiment of the present invention. Generally, the configuration of the wrench 1 is similar in shape to that of a conventional type open-end wrench having a handle and a wrenching head at one end or both ends. For the purpose of simplicity in illustrating the invention, only one head end of the wrench is disclosed herein. Both ends of the wrench can be constructed in similar manner. The wrench 1 has a handle and a head. The head has a first or left jaw having an inner surface that is defined as the first driving surface and a second or right jaw having an inner surface that is defined as the second driving surface. A nest portion interconnects the first driving surface and the second driving surface. The head has a mouth area formed by the inner surface of the first jaw, the inner surface of the second jaw, and the nest portion. The inner surface of the first jaw has a first convex surface portion 11 facing the mouth area as shown in FIG. 15. The inner surface of the second jaw is provided with three sections identified as follows:

- a first section consisting of a first transverse tooth 12 that is located at the outer or distal end of the second jaw, which faces the mouth area and which is remote or farthest from the nest;
- a second section consisting of a second transverse tooth 13 which is located adjacent the first transverse tooth 12; and
- a third section consisting of a second convex surface portion 14 which is arranged between the second transverse tooth 13 and the nest portion.

The second convex surface portion 14 can be spaced or arranged at a short distance from the second transverse tooth 13. The first tooth 12 has a pointed peak with a triangular cross section with an apex P4 of the triangle facing the mouth area. See, for example, FIG. 17. The second tooth 13 has a smoothly curved peak. The structural arrangement of the three sections provides a sturdy and firm grasping means for the second jaw.

Figure 18:
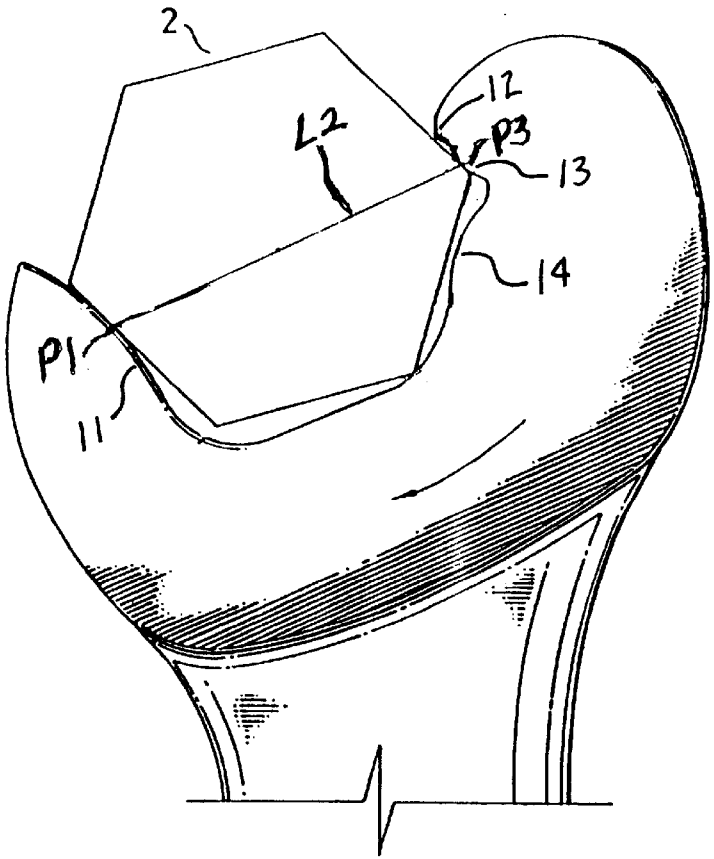
FIG. 18 is similar to FIG. 17 but showing the wrench in a slightly turned position.
Figure 17:
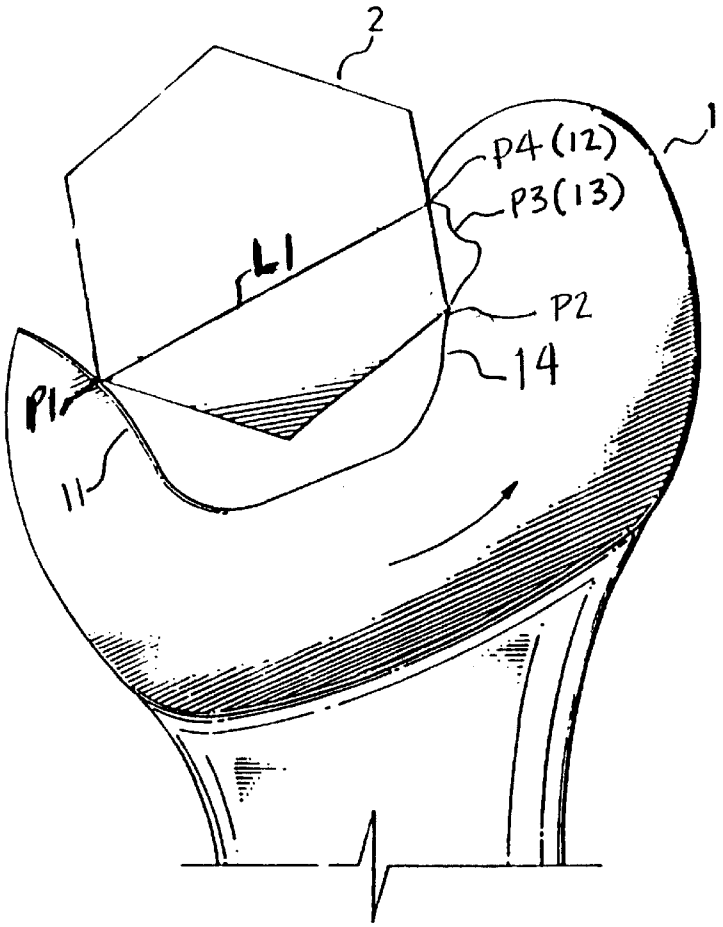
FIG. 17 is similar to FIG. 16, showing a hexagon fastener inserted within the mouth and a dimensional display.

Attention is respectfully directed to FIGS. 17 and 18. When the open end of the open-end wrench 1 is arranged about a fastener, such as a normal hexagon head bolt 2, the first and second convex surface portions 11, 14 respectively permit a free-rotating ratcheting action in one direction, such as shown by the arrow in FIG. 17. When the wrench is turned in the direction of the arrow shown in FIG. 17, angular movement (two angles or corners) of the hexagon head of a hexagon head bolt 2 is permitted. The first transverse tooth 12 and the second transverse tooth 13 also permit similar free movement relative to the wrench, such as along a side of the hexagon shaped head of the hexagon head bolt 2 (see FIG. 17), when the wrench is turned in the direction of the arrow shown in FIG. 17.

In the power rotation movement or torque stroke, the wrench is turned opposite to the direction shown in FIG. 17 and in the direction shown by the arrow in FIG. 18. In the power rotation movement turning, as shown in FIG. 18, the second transverse tooth 13 is forced into engagement with one side or corner of the hexagon head of the hexagon head bolt 2, and therefore the hexagon head bolt 2 is positively grasped and turned.

Figure 19:
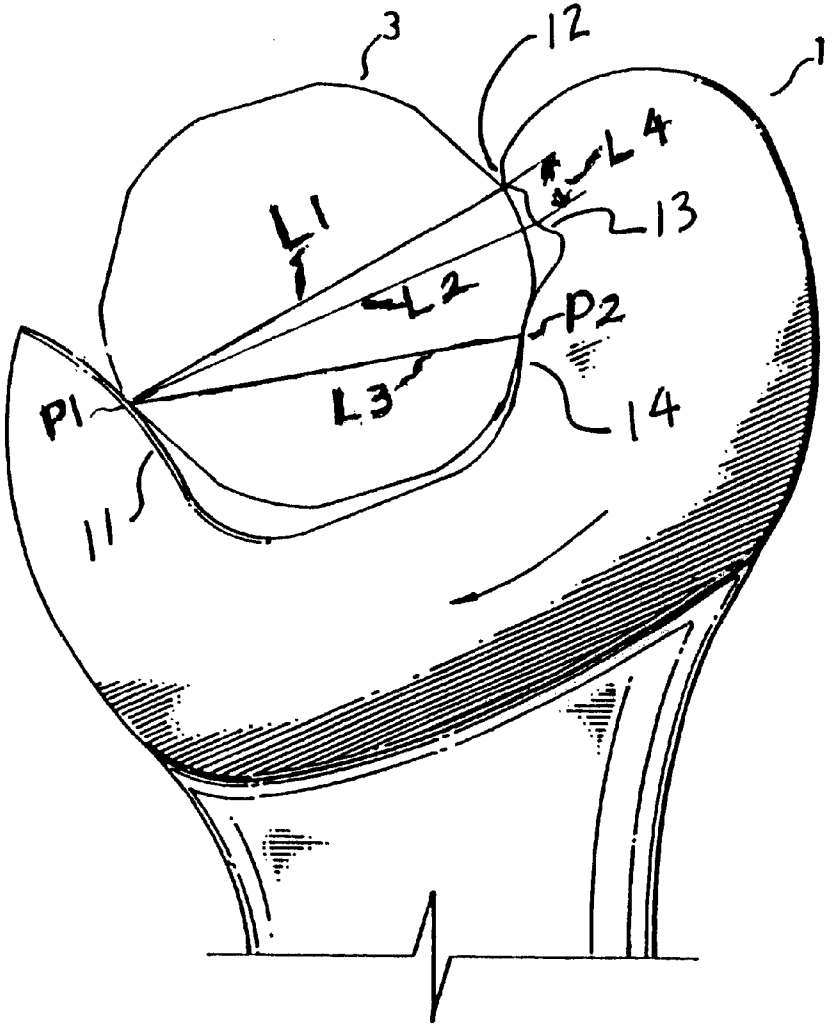
FIG. 19 shows the first embodiment's open-end wrench structural arrangement with a worn-out hexagon fastener operatively inserted therein.

FIG. 19 shows an open-end wrench 1 engaging a worn-out hexagon fastener 3, where the first and second convex surfaces 11, 14, and the tip or the apex of the first transverse tooth engage sides of the worn-out hexagon fastener 3. In other words, depending upon the shape of the nut (i.e., worn or unworn hexagon nut), surfaces 11, 12 and 14 can engage the nut as shown in FIG. 19, or surfaces 11, 12 and 13 can engage the nut as shown in FIG. 18.

Accordingly, the first embodiment in FIGS. 17–19 has provided an open-end wrench structural arrangement 1 for use in grasping and turning new or worn fasteners. The first transverse tooth 12, the second transverse tooth 13 and the second convex surface portion 14 are dimensionally spaced from the midpoint P1 of the first convex surface portion 11 and these critical limitations have been determined to exist in terms of a ratio of 25:26:24 units as follows:

First: A first dimensional line L1 is defined as extending between the midpoint P1 of the first convex surface 11 to the apex P4 of the first tooth 12. The midpoint P1 can also be the apex of the first convex surface portion 11, that is, it can represent the highest point of the first convex surface 11 relative to a straight line passing through the endpoints of the convex surface 11. The length of line L1 is 25 units, where a single unit is defined as a measure of length that can be set by the maker of the wrench. The length of unit is set so that 25 units will represent a length for L1 which permits the open-end of the mouth of the wrench to receive and hold the heads of standard hexagon head bolts. For example, a unit can equal 0.5 millimeters for a smaller hexagon head bolt, 3.0 millimeters for a larger hexagon head bolt, or other lengths, below, above and between 0.5 and 3.0 millimeters.

Second: A second dimensional line L2 is defined as extending between the midpoint P1 of the first convex surface 11 to the apex P3 of the second tooth 13, as shown in FIG. 18. The apex P3 of the second tooth 13 can represent the highest point of the curved surface of the second tooth 13 relative to a straight line passing through the endpoints of the curved surface of the second tooth 13. The length of line L2 is 26 units. Thus, the length ratio of L1 to L2 is 25:26. For example, if L1 has a length of 25 mm (the unit being 1 mm), the L2 has a length of 26 mm.

Third: A third dimensional line L3 is defined as extending between midpoint P1 of first convex surface portion 11 and midpoint P2 of the second convex surface 14, as shown in FIG. 19. The midpoint P2 can also be the apex of the second convex surface 14, that is, it can represent the highest point of the second convex surface 14 relative to a straight line passing through the endpoints of second convex surface 14. The length of line L3 is 24 units. Thus, the length ratio of L1 to L3 is 25:24. For example, if L1 has a length of 25 mm (the unit being 1 mm), then L3 has a length of 24 mm, and the ratio of the lengths L1:L2:L3 is 25 mm:26 mm:24 mm.

A further critical limitation has to do with a fourth dimensional line L4. L4 is defined as extending between apex P4 of the first transverse tooth 12 and the midpoint P3 of the second transverse tooth 13. L3 has a length of 3 units. Thus, the length ratio of L4 to L1 is 3:25. For example, if L1 has a length of 25 mm (the unit thus being 1 mm), then L4 has a length of 3 mm.

Thus, in the present invention, there are improved grasping and turning functions derived by the actions of the instant open-end structural arrangement between the bolt 2 and the driving surfaces of the jaw members. Accordingly, such functions are achieved with the use of the specific structural arrangement of the present invention. For example, in the operative use of the wrench of the first embodiment having the specific dimensions disclosed herein, there is a driving function provided by the first pointed peak tooth 12 and the smoothly curved peak second tooth 13. It has been determined that the specific unit dimensions stated herein of the precise distances from the central point P1 of the first convex surface portion 11 of the first jaw are critical limitations for achieving these functions.

The above-identified dimensional data as disclosed with respect to the first embodiment of FIGS. 17 to 19 can be mathematically and experimentally determined that such dimensions for the respective distances are critical for providing for a positively grasping and turning of fasteners.

Figure 20:
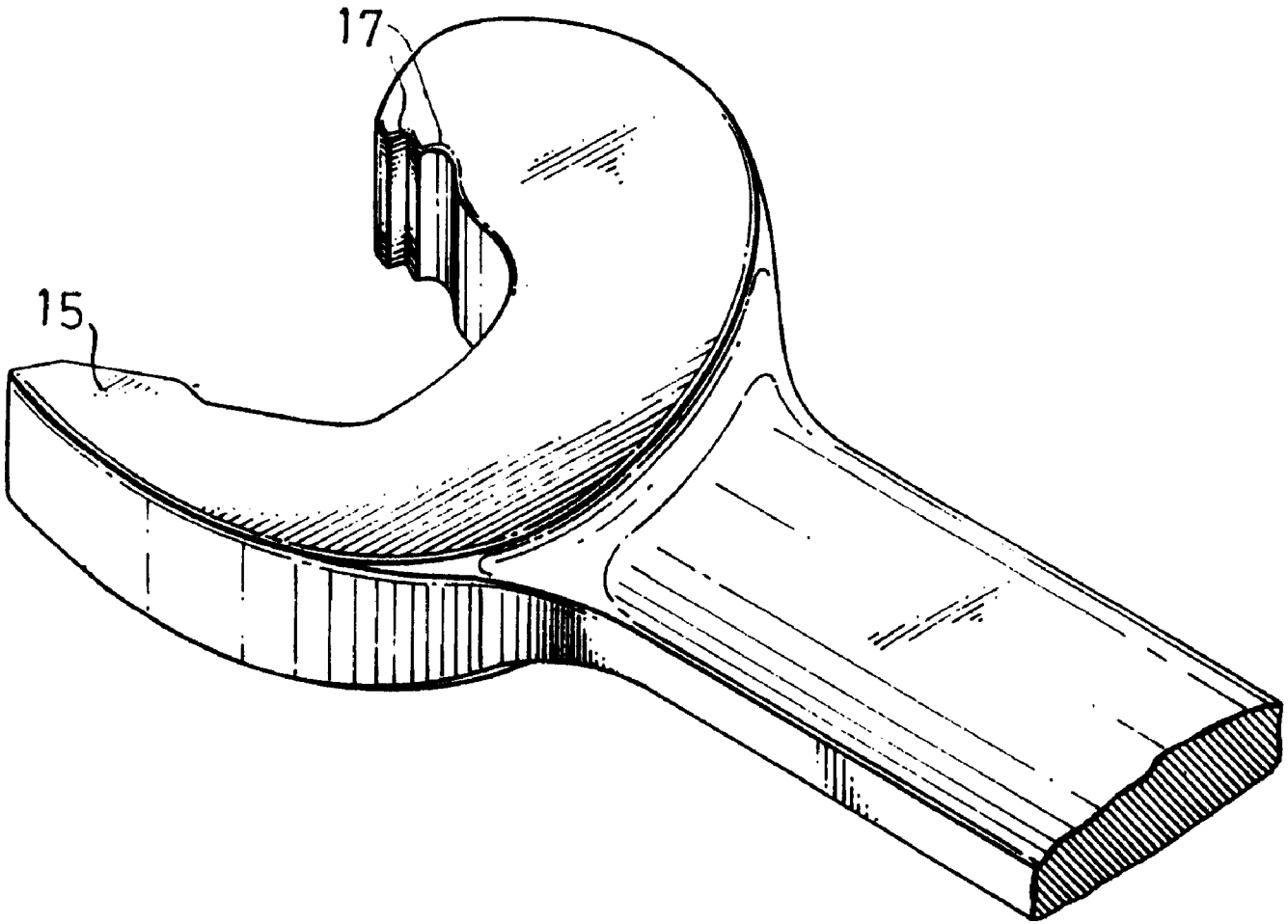
FIG. 20 is a perspective view of an open-end wrench structural arrangement according to the second embodiment of the present invention.
Figure 21:
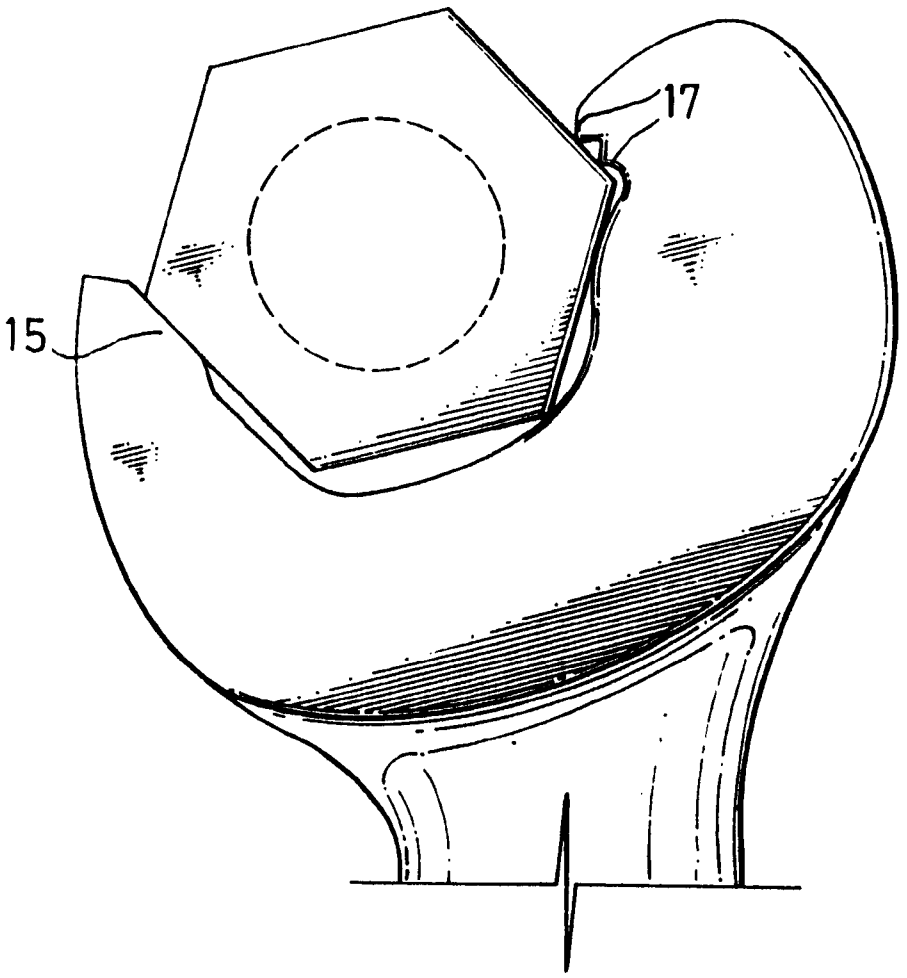
FIG. 21 shows the second embodiment's open-end wrench of FIG. 20 with a hexagon head fastener operatively inserted therein.

Further, it is to be understood that the present invention is not limited to the first embodiment described above, but encompasses further embodiments as follows:

Accordingly, with reference to FIGS. 20 and 21, there is illustrated another open-end wrench structural arrangement in accordance with the second embodiment of the present invention. In this structural arrangement, the first jaw has a flat nose 15 at an inner side facing the mouth (instead of the aforesaid first convex surface portion 11). In the second jaw, there is provided a pair of similar teeth 17 having pointed peaks. This is in lieu of the structural arrangement of the first and second teeth 12, 13 and the second convex surface 14 of the first embodiment.

Figure 22:
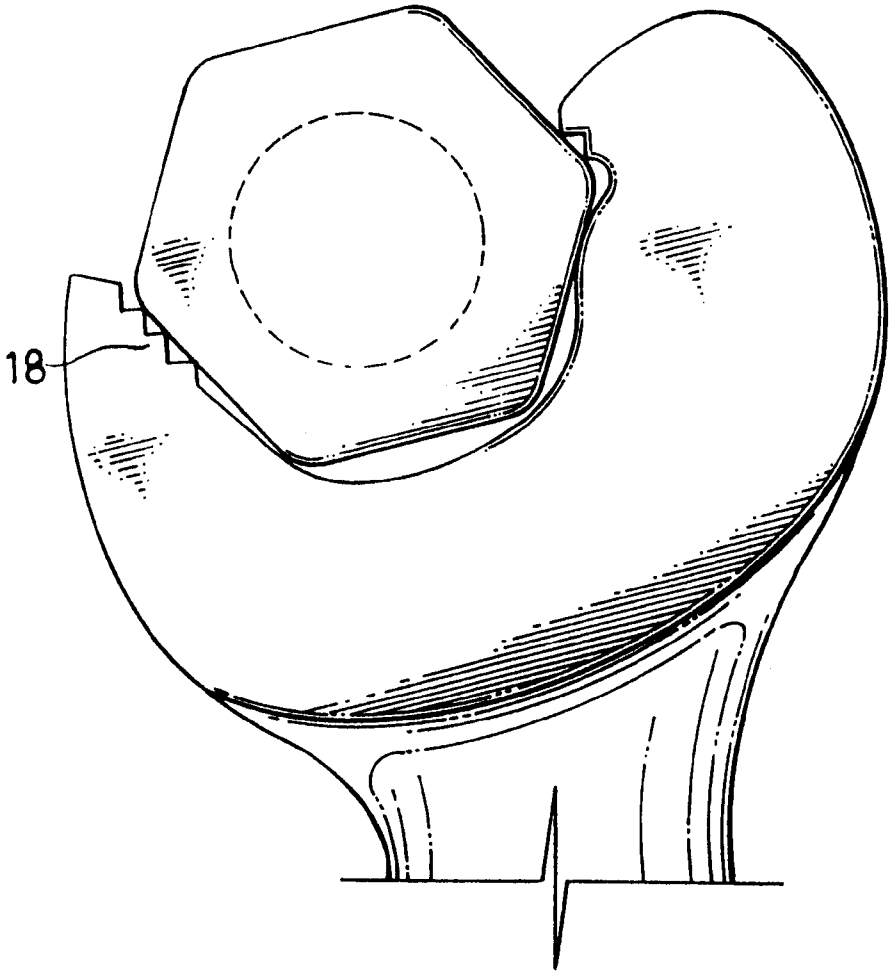
FIG. 22 shows the front view of an open-end wrench structural arrangement with a hexagon fastener according to a third embodiment of the present invention.

Accordingly, with reference to FIG. 22, there is illustrated another open-end wrench structural arrangement in accordance with the third embodiment of the present invention. In this structural arrangement, the first jaw is provided with a series of serrated teeth 18 in lieu of the flat nose 15 of the second embodiment. The pair of pointed peak teeth 17 of the second jaw in this embodiment is the same as it is in the second embodiment.

It is to be understood that the present invention is not limited to the embodiments described above, but encompasses any and all embodiments within the scope of the following claims.

What is claimed is:

1. An open-end wrench structural arrangement for use in grasping and turning fasteners, comprising:

a first jaw having a first driving surface;

a second jaw having a second driving surface;

a nest portion interconnecting said first driving surface and said second driving surface;

a mouth area substantially defined by said first driving surface of said first jaw, said second driving surface of said second jaw, and said nest portion;

said first driving surface of said first jaw having a first convex surface portion facing the mouth area;

said second driving surface of said second jaw including:

a first transverse tooth being located at a distal end of said second jaw and facing the mouth area, said first transverse tooth having a pointed apex;

a second transverse tooth being located adjacent the said first transverse tooth and facing the mouth area, said second transverse tooth having a smoothly curved apex; and a second convex surface portion being located between the second transverse tooth and said nest portion and facing the mouth area;

wherein the first transverse tooth, the second transverse tooth and the second convex surface portion are dimensionally spaced from a midpoint of the first convex surface portion in the ratio of 25:26:24 units as follows, respectively:

wherein a first distance of 25 units extends from the midpoint of first convex surface portion to the apex of the first tooth;

wherein a second distance of 26 units extends from the midpoint of first convex surface portion to a midpoint of the second tooth; and wherein a third distance of 24 units extends from the midpoint of first convex surface portion to a midpoint of the second convex surface portion.

2. The open-and wrench structural arrangement of claim 1, wherein a fourth distance of 3 units extends between the apex of the first transverse tooth and the midpoint of the second transverse tooth area.

3. An open-end wrench structural arrangement for use in grasping and turning fasteners, comprising:

a first jaw having a first driving surface;

a second jaw having a second driving surface;

a nest portion interconnecting said first driving surface and said second driving surface;

a mouth area substantially defined by said first driving surface of said first jaw, said second driving surface of said second jaw, and said nest portion;

said first driving surface of said first jaw having a first convex surface portion facing the mouth area;

said second driving surface of said second jaw including:

a first transverse tooth being located at a distal end of said second jaw and facing the mouth area, said first transverse tooth having a pointed apex;

a second transverse tooth being located adjacent the said first transverse tooth and facing the mouth area, said second transverse tooth having a smoothly curved apex; and a second convex surface portion being located between the second transverse tooth and said nest portion and facing the mouth area;

wherein the first convex surface portion, the second convex surface portion, first transverse tooth, and the second transverse tooth permit free-rotating ratcheting action when the wrench is turned in one direction, and wherein the first convex surface portion and the second transverse tooth provide driving surfaces; or the first convex surface portion, the second convex surface portion and the first transverse tooth provide driving surfaces; when the wrench is turned in a second direction.

* * * * *